US006004023A

United States Patent [19]

Koyanagi et al.

[11] Patent Number: 6,004,023

[45] Date of Patent: Dec. 21, 1999

[54] CONTROL APPARATUS FOR SOIL IMPROVEMENT MACHINE

[75] Inventors: Satoru Koyanagi; Kazuyuki Yamazaki; Hiroshi Shimizu, all of Kanagawa-ken, Japan

[73] Assignee: Komatsu Ltd., Tokyo, Japan

[21] Appl. No.: 09/011,495

[22] PCT Filed: Aug. 30, 1996

[86] PCT No.: PCT/JP96/02457

§ 371 Date: Feb. 9, 1998

§ 102(e) Date: Feb. 9, 1998

[87] PCT Pub. No.: WO97/08397

PCT Pub. Date: Mar. 6, 1997

[30] Foreign Application Priority Data

Aug. 31, 1995 [JP] Japan ..... 7-223320

[51] Int. Cl.[6] ..... B01F 15/02; B28C 7/04

[52] U.S. Cl. ..... 366/17; 366/19; 241/34

[58] Field of Search ..... 366/17, 16, 19, 366/30, 151.1, 160.5; 222/52, 59, 344, 367, 368; 241/34

[56] References Cited

U.S. PATENT DOCUMENTS 4,427,297 1/1984 Stastny ..... 366/19
4,997,284 3/1991 Tousignant et al. ..... 366/16
5,503,473 4/1996 Dearing, Sr. et al. ..... 366/17

FOREIGN PATENT DOCUMENTS 56-59262 5/1981 Japan .
58-76657 5/1983 Japan .
62-39827 3/1987 Japan .
5-51942 3/1993 Japan .
7-127090 5/1995 Japan .

*Primary Examiner*—Tony G. Soohoo
*Attorney, Agent, or Firm*—Wenderoth, Lind & Ponack, L.L.P.

[57] ABSTRACT

A soil refining machine having a crushing and mixing unit (A), an earth and sand material delivery unit (B) for supplying earth and sand material into the crushing and mixing unit and a soil refining material delivery unit (C) for supplying soil refining material into the crushing and mixing unit is provided with a control apparatus. The control apparatus includes: a sensing unit (31) for detecting a supply rate of the earth and sand material being supplied by the earth and sand material delivery unit; a first setting unit (47) for optionally establishing a supply rate of the soil refining material to be supplied by the soil material delivery unit; and a control unit (43) responsive to both the rate established by the first setting unit and the rate detected by the sensing unit for controlling an actual supply rate of the soil refining material being supplied by the soil refining material delivery unit.

4 Claims, 4 Drawing Sheets

CONTROL APPARATUS FOR SOIL IMPROVEMENT MACHINE

TECHNICAL FIELD

The present invention relates to a control apparatus for a soil refining machine, i. e., a machine for producing an earth and sand material of improved quality from an earth and sand material of very bad quality which is typically yielded from usual or rough ground, e. g., where the ground is excavated during construction work for embedding a gas, water, sewer or similar pipe therein. The machine operates by mixing the earth and sand material of very bad quality with a soil refining material such as lime or cement to obtain the earth and sand material of better quality that can be used as a ground re-filling or reclaiming material. More particularly, this invention relates to a control apparatus for use in such a soil refining machine for controlling the supply rate of the soil refining material and so forth.

BACKGROUND ART

Where construction work of the type described is carried out, it is customary to excavate the ground to form a groove therein, to lay a pipe in the groove and thereafter to fill the groove back to the ground level with a re-filling material. In a case where the excavated ground material i. e., a soil and sand material, contains plenty of water or moisture, or pebbles, rocks, concrete pieces and so forth with a resultant deteriorated soil quality, the material cannot properly be utilized as a groove refilling material.

Where the excavated ground material is thus of very bad quality as described, it has hitherto been a customary requirement for a proper re-filling material of acceptable soil quality to be specifically called for and carried on a truck or the like transportation vehicle to re-fill the excavated groove therewith back to the ground level or, on the other hand, for the excavated ground material to be designated for disposal as waste earth and sand material. Not only has this rendered pipe laying construction work very costly but also has resulted in an undesirably extended period of time required for each such individual installation job.

There has also hitherto been known a machine for refining an earth and sand material of very deteriorated quality as described above into an improved soil quality. A typical example of such a machine has been disclosed, e. g., in Japanese Unexamined Utility Model Publication No. Sho 62-39827.

The typical soil refining machine is constructed of a hopper for an earth and sand material whose soil quality is to be improved, an earth and sand material transporting belt conveyer, a hopper for a soil refining material, a soil refining material transporting mechanism, a crushing and mixing device and so forth which are together mounted upon a frame. The machine is designed to operate in such a manner that earth and sand material of very bad quality stored in the earth and sand material hopper may be carried by the earth and sand material transporting belt conveyer into the crushing and mixing device whereas a soil refining material stored in the soil refining material hopper may be carried into the crushing and mixing device by the soil refining material transporting mechanism whereupon the earth and sand material and the soil refining material may be crushed, stirred and uniformly mixed together in the crushing and mixing device to give rise to earth and sand material of acceptable soil quality.

Where the soil quality is being thus upgraded from a very bad level to a highly satisfactory level with a soil refining machine as described above, it has been found to be critical to bring the CBR (i. e., an index that is used to evaluate the ability to support a load) of the soil quality refined earth and sand material to an appropriate level.

As with a soil refining machine as described above in which both the earth and sand material and the soil refining material are designed to be each fed invariably by a given amount, however, it has also been found that if the nature (including the kind, percentage of water content, etc.) of the earth and sand material varies, the proportion of the soil refining material to the earth and sand material for supply would remain constant, thus causing the CBR value of the soil quality refined earth and sand material to largely vary.

It has further been observed that the earth and sand material delivered into the crushing and mixing device may vary in amount, depending on the amount of the earth and sand material stored in the earth and sand material hopper. Then, too, the CBR value of the soil quality refined earth and sand material would vary, given a constant amount of supply of the soil refining material.

Accordingly, with the above mentioned problems in the prior art taken into account, it is an object of the present invention to provide control apparatus for a soil refining machine whereby a soil quality refined earth and sand material is always given an appropriate value of CBR.

SUMMARY OF THE INVENTION

In order to achieve the above mentioned object, there is provided in accordance with the present invention a control apparatus for a soil refining machine that has a crushing and mixing means, an earth and sand material delivery means for supplying an earth and sand material into the crushing and mixing means, and a soil refining material delivery means for supplying a soil refining material into the crushing and mixing means, characterized in that the control apparatus comprises: a sensing means for detecting a supply rate of the earth and sand material being supplied by the said earth and sand material delivery means; a first setting means for optionally establishing a supply rate of the soil refining material to be supplied by the soil refining material delivery means; and a control means responsive to both the rate established by the first setting means and the rate detected by the sensing means for controlling an actual supply rate of the soil refining material being supplied by the soil refining material delivery means.

According to the construction described above in which where the nature of the earth and sand material varies the supply rate of the soil refining material can be established by the first setting means and where the supply rate of the earth and sand material varies the supply rate of the soil refining material can then also likewise be regulated, it can be seen and should be understood that by casting into the crushing and mixing means the soil refining material at a supply rate in accordance with the nature of the earth and sand material and its supply rate, the CBR of the soil quality refined earth and sand material can always be a value that is appropriate.

In the construction mentioned above, it should be noted that the apparatus may further comprise: a second setting means for optionally establishing a supply rate of the earth and sand material to be supplied by the earth and sand material delivery means.

Also in the construction mentioned above, it is preferred that the crushing and mixing means be provided with an inlet opening;

that the earth and sand delivery means comprise an earth and sand material hopper with a bottom area thereof having an earth and sand material discharge outlet opening located above the inlet opening, and an earth and sand material feeder rotatably mounted in the earth and sand material hopper and adapted to be driven by a first drive source;

that the soil refining material delivery means comprise a soil refining material hopper with a bottom area thereof having a soil refining material discharge outlet opening located at a position offset from a position at which the earth and sand material discharge outlet opening is located in a direction opposite to a direction in which the earth and sand material feeder is to be rotated, and a soil refining material feeder rotatably mounted in the soil refining material hopper and adapted to be driven by a second drive source;

that the sensing means be located at a position offset from a position in which the soil refining material discharge outlet opening is located in a direction opposite to the direction in which the earth and sand material feeder is to be rotated;

that the first setting means be adapted to preset a speed of rotation of the second drive source optionally; and that the control means be adapted to control the speed of rotation of the second drive source in response to both the rate established by the first setting means and the rate detected by the sensing means.

According to the construction described in the preceding paragraph, it can be seen and should be understood that by permitting a soil refining material to be supplied upon earth and sand material in the earth and sand material feeder, the earth and sand material can be cast simultaneously with the soil refining material into the crushing and mixing means, thereby improving its soil quality.

Also, since this arrangement enables the speed of rotation of the soil refining material feeder to be established in accordance with the nature of the earth and sand material and to be regulated in accordance with the supply rate of the earth and sand material it can be seen and should be understood that simply by casting into the crushing and mixing means the soil refining material at its supply rate that is commensurate with both the nature and the supply rate of the earth and sand material, an appropriate CBR value of the soil refined earth and sand material can result.

Also, in the construction mentioned above, it is preferred that the earth and sand material delivery means include a plurality of feeder chambers constituting the earth and sand material feeder, and a raking blade located at a position offset from the position at which the soil refining material discharge opening is located and in a direction opposite to the direction in which the earth and sand material feeder is to be rotated for maintaining an amount of the earth and sand material received in a feeder chamber substantially constant;

that the sensing means be disposed intermediate between the raking blade and the soil refining material discharge outlet opening; and that the control means be assigned a function to compute from the rate detected by both the sensing means and a speed of rotation of the first drive source a time period it will take a feeder chamber to arrive at the soil refining material discharge outlet opening as well as a function to bring the speed of rotation of the second drive source into coincidence with a controlled value after the time period has elapsed.

According to the construction described in the preceding paragraph, it can be seen and understood that by virtue of the fact that the amount of the earth and sand material in each individual feeder chamber can be made substantially constant and the soil refining material feeder can be rotated at a predetermined speed of rotation when each feeder chamber has arrived at the soil refining material discharge outlet opening of the soil refining material hopper, the supply rate of the soil refining material can be made a correct value that is commensurate with the amount of the earth and sand material in the feeder chambers, thereby permitting an appropriate value of CBR of the soil quality refined earth and sand material to ensue.

Further in the construction mentioned above, it is preferred that the control means be adapted to control the speed of rotation of the second drive source and the speed of rotation of the first drive source simultaneously, thereby permitting the earth and sand material feeder and the soil refining material feeder to rotate at their respective speeds of rotation which are proportioned at a substantially constant ratio.

It can be seen and should be understood that the construction described in the preceding paragraph enables the soil refining material to be uniformly supplied upon the earth and sand material in the feeder chambers since the earth and sand material feeder and the soil refining material feeder are allowed to rotate at their respective speeds of rotation which are proportioned at a substantially constant ratio, thereby permitting an even more appropriate value of CBR of the soil quality refined earth and sand material to ensue.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

DETAILED DESCRIPTION OF THE INVENTION

Hereinafter, suitable embodiments of the present invention with respect to a control apparatus for a soil refining machine will be set forth with reference to the accompanying drawings hereof.

(Entire Structure of the Soil Refining Machine)

Figure 1:
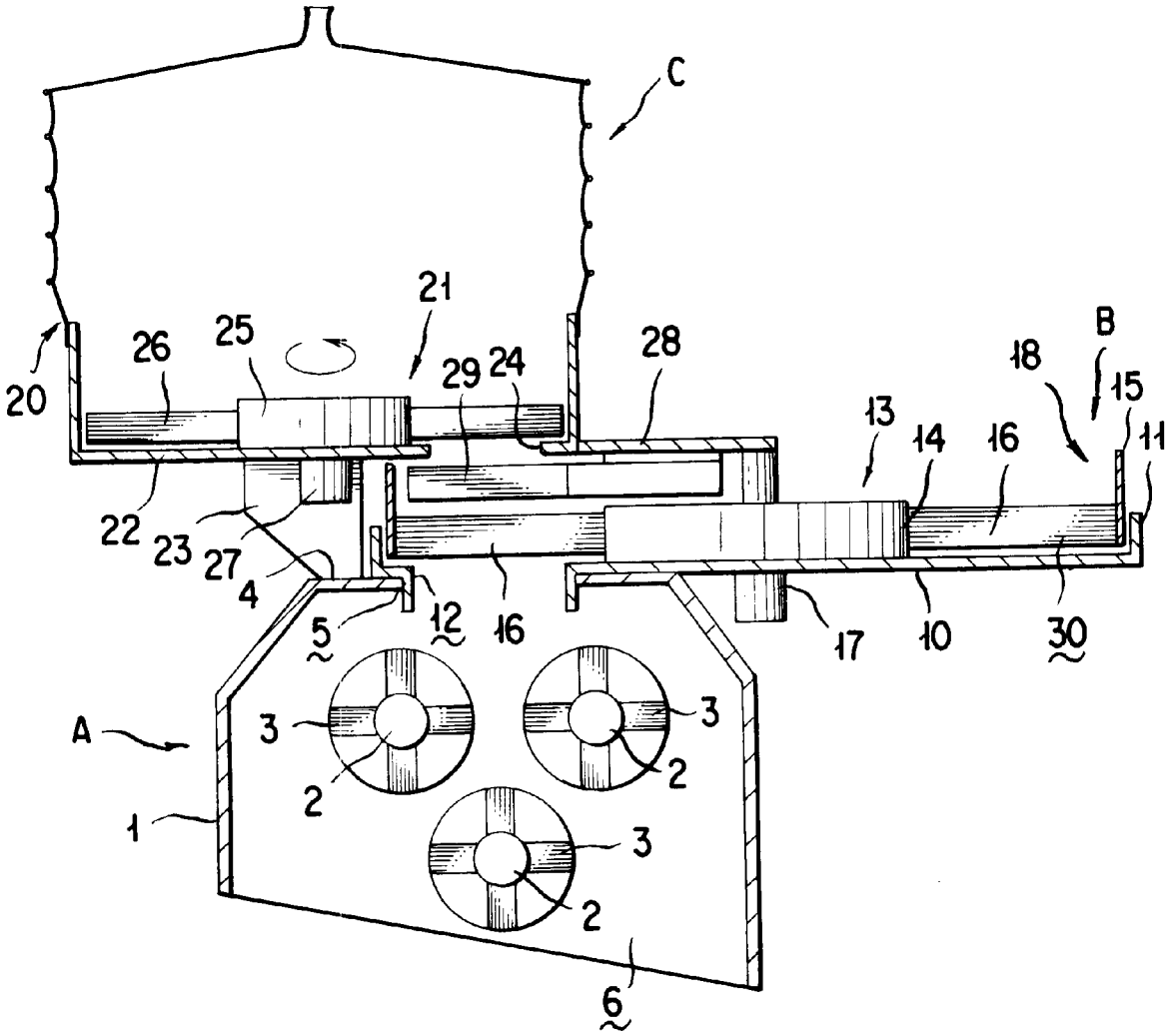
FIG. 1 is a cross sectional view in elevation that shows a soil refining machine which incorporates a certain embodiment of the control apparatus according to the present invention.

As shown in FIG. 1, it is seen that a crushing and mixing unit A has an earth and sand material delivery unit B mounted thereon, the latter B has a refining material delivery unit C mounted thereon, the units A, B and C together constituting a soil refining machine or system to be acted on by a control apparatus according to the present invention.

It should be noted here that the crushing and mixing unit A is mounted on the body portion of a traveling vehicle unit, the earth and sand material delivery unit B is supported on the same vehicle body, and the refining material unit C is carried by both the vehicle body and the crushing and mixing unit A.

The crushing and mixing unit A is provided in a housing 1 with a plurality of rotatable shafts 2, on each of which are radially arranged a plurality of shredding and mixing elements 3. The unit A is so constructed that when an earth and sand material and a refining material are cast into it through an inlet opening 5 formed in an upper wall 4 of the housing 1, the earth and sand material may be shredded into fine particles while those particles and the soil refining material may be mixed and stirred together to yield a refined earth and sand material that is discharged out of a lower portion of the housing 1.

First, it may be noted that the earth and sand material delivery unit B is formed with a bottom plate 10, which is circular in a planar configuration and is provided with a ring shaped outside member 11 upstanding on and along a rim or outer peripheral edge thereof. The bottom plate 10 is further formed therein closer to the latter with an earth and sand discharge outlet opening 12 such that it may be opposed to the inlet opening 5 of the crushing and mixing unit A.

The bottom plate 10 mentioned above includes a rotary type earth and sand material feeder 13 that is provided so as to be rotatable. The earth and sand material feeder 13 has a ring shaped inner wall 14 and a ring shaped outer wall 15 between which a plurality of feeder blades 16 are provided so as to be equally spaced apart from one another, each extending essentially in a radial direction. The earth and sand material feeder 13 is designed to be rotationally driven by means of a hydraulic motor 17.

The outer wall 15 of the rotary type earth and sand material feeder 13 is arranged to project upwards so as to be higher than the inner wall 14 thereof, with the outer wall 15 and the bottom wall 10 together constituting an earth and sand material hopper 18. Alternatively, it should be noted that the outside upstanding member 11 of the bottom plate 10 may be arranged so as to be higher than the inner wall 14 and the outer wall 15 thereof and may together with the bottom plate 10 constitute the earth and sand hopper 18.

The soil refining material delivery unit C mentioned above includes a soil refining material hopper 20, which is provided at its bottom with a rotary type soil refining material feeder 21 so as to be rotatable. The soil refining material hopper 20 has a bottom plate 22 mounted on the upper wall 4 of the housing 1. The bottom plate 22 is partially located above a portion of the earth and sand material rotary feeder 13 and is formed in an area thereof with a soil refining material discharge outlet opening 24.

The soil refining material rotary feeder 21 comprises a plurality of radially extending feeder blades 26 attached to a rotary member 25 which is adapted to be driven rotationally by an electric motor 27.

The soil refining material hopper 20 has an upper side expandable and collapsible so as to make its height adjustable. And its top is made capable of being opened and closed. In a typical construction, the top portion of the hopper 20 can be tied by strings to be closed and can be opened by loosening the strings.

The bottom plate 22 of the soil refining material hopper 20 has a cover 28 integrally attached thereto, which in turn has a raking blade 29 attached thereto.

Figure 2:
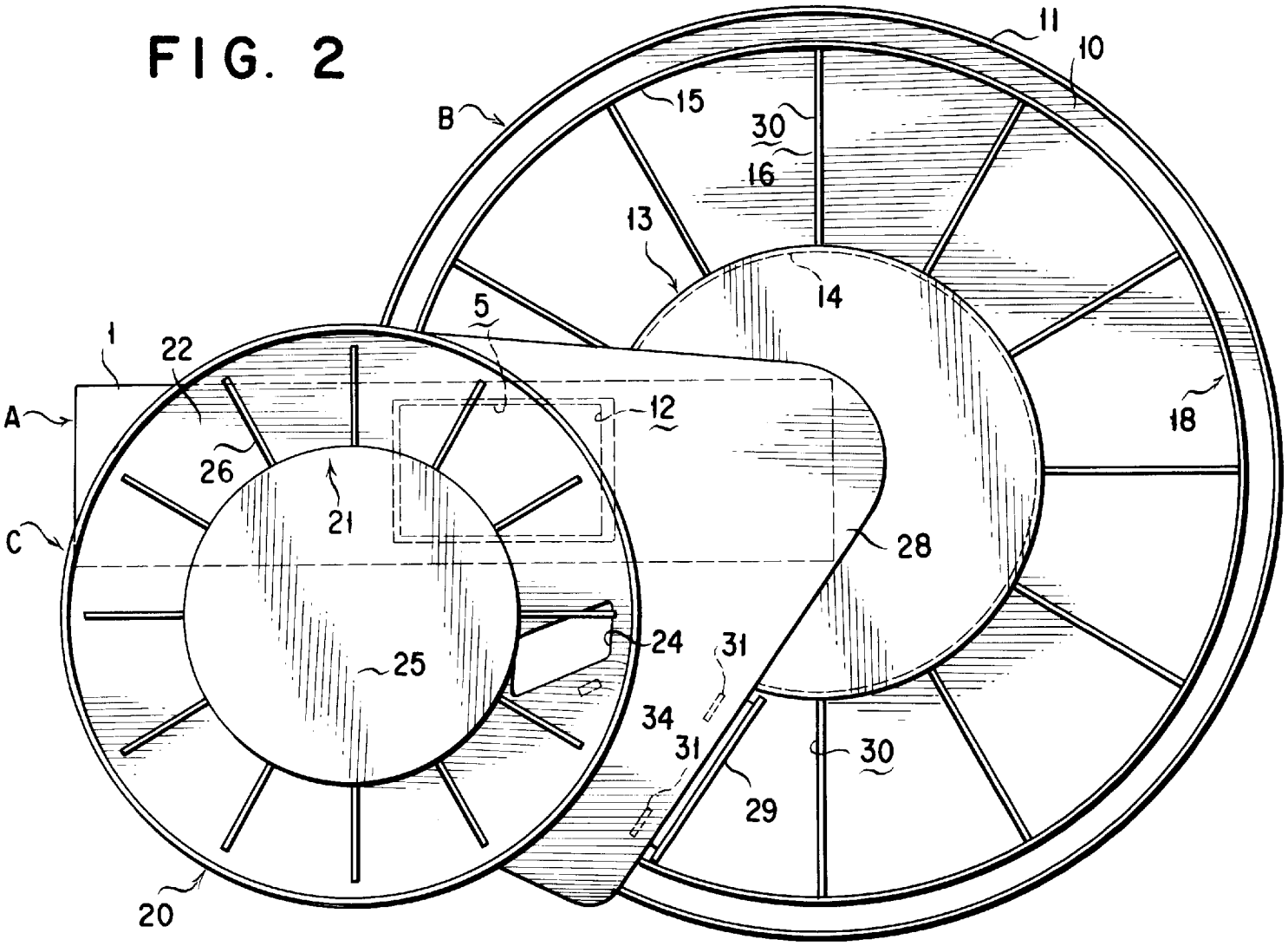
FIG. 2 is a top plan view that shows the above mentioned soil refining machine.

The raking blade 29, as shown in FIG. 2, is located at a position offset from a position at which the earth and sand discharge outlet opening 12 is located in a direction opposite to the direction in which the rotary type earth and sand material feeder 13 is to be rotated, and is positioned above the level in which a series of feeder chambers 30 are formed by the feeder blades 16 between the inner wall 14 and the outer wall 15. There being a small gap between the raking blade 29 and each individual one of the feeder blades 16 coming thereunder, the raking blade 29 is provided to act to maintain a amount of the earth and sand material contained in each of the feeder chambers 30 substantially constant.

The soil refining material discharge outlet opening 24 of the above mentioned soil refining material delivery unit C, as shown in FIG. 2, is located at a position intermediate between the raking blade 29 and the soil refining material discharge outlet opening 24 and opens above each feeder chamber 30 which comes thereunder to permit the soil refining material to fall by gravity upon the earth and sand material fixed in amount as described above in the feeder chamber 30.

Figure 3:
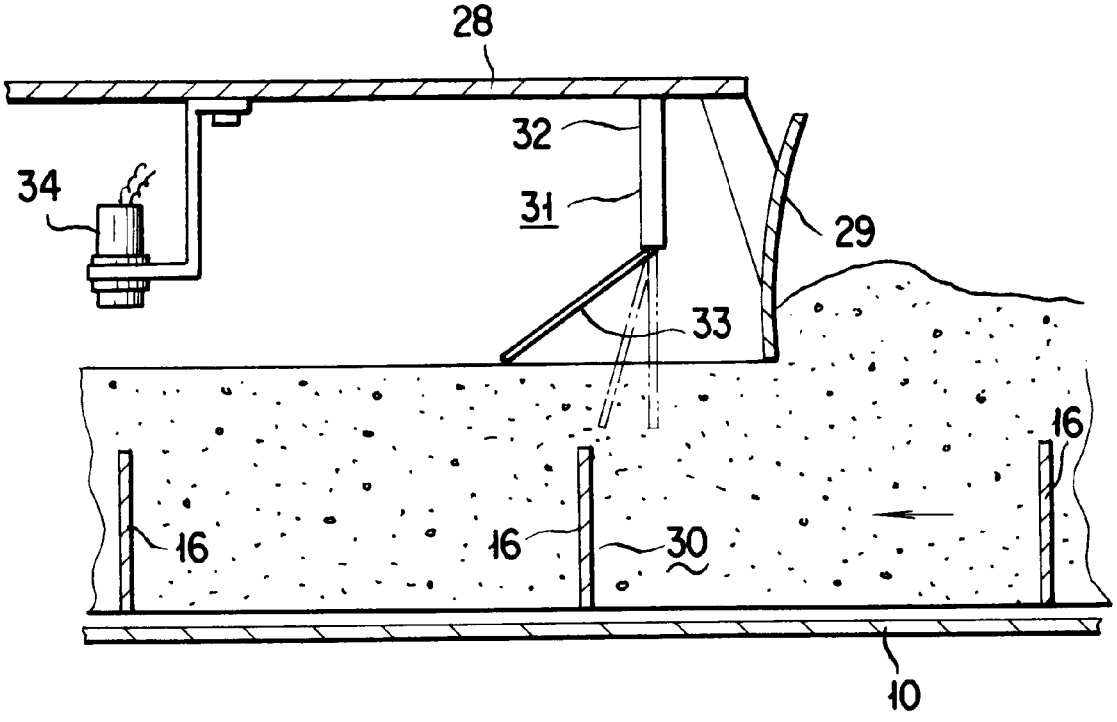
FIG. 3 is a cross sectional view in elevation that shows a portion of the present invention, in which an earth and sand material supply rate sensing switch and an earth and sand feeder blade position sensing switch are arranged.

At a position intermediate between the raking blade 29 and the soil refining material discharge outlet opening 24 in the above mentioned cover 28, an earth and sand supply rate sensing means, e. g. an earth and sand material switch 31, is attached thereto. As shown in FIG. 3, the earth and sand material switch 31 consists of a switch body portion 32 and a movable part 33 such that when the movable part 33 is oriented vertically, its lower end may be located slightly upwards of the upper face of each of the feeder blades 16 coming thereunder. And, the movable part 33 is adapted to be swung upwards by the earth and sand material in each feeder chamber 30 that has passed under the raking blade 29 so that while it is swung from the position shown by the vertical line (the two dot line) to the position shown by the one dot chain line the switch 31 may remain OFF; and when it is swung from the position shown by the one dot chain line to the position shown by the real line, the switch 30 may be turned ON. Thus, the switch 31 is designed to furnish an ON signal if the feeder chamber 30 is filled full of the earth and sand material and otherwise to furnish an OFF signal.

It should be noted at this point that rather than such ON and OFF digital signals, an analog signal that varies in accordance with the swinging angle of the movable part 33 may be furnished.

At a position offset from the position at which the soil refining material discharge outlet opening 24 of the rotary type soil refining material feeder 21 is located and in a direction opposite to the direction in which the earth and sand material feeder 13 is being rotated, a position sensing means, e. g., an earth and sand material feeder blade position sensing switch 34, is arranged. Such an earth and sand material feeder blade position sensing switch 34 may, as shown in FIG. 3, be a non-contact type proximity switch known in the switch art and is here designed to be turned ON when each feeder blade 16 is coming close to the soil refining material discharge outlet opening 24, and to furnish a signal somewhat before the feeder chamber 30 arrives at the soil refining material discharge outlet opening 24. If the state of the earth and sand material switch 31 is stored while taking a timing with this signal, it will be seen that it can be ascertained after how many seconds the earth and sand material in the feeder chamber 30 detected is about to come under the soil refining material discharge outlet opening 24.

Figure 4:
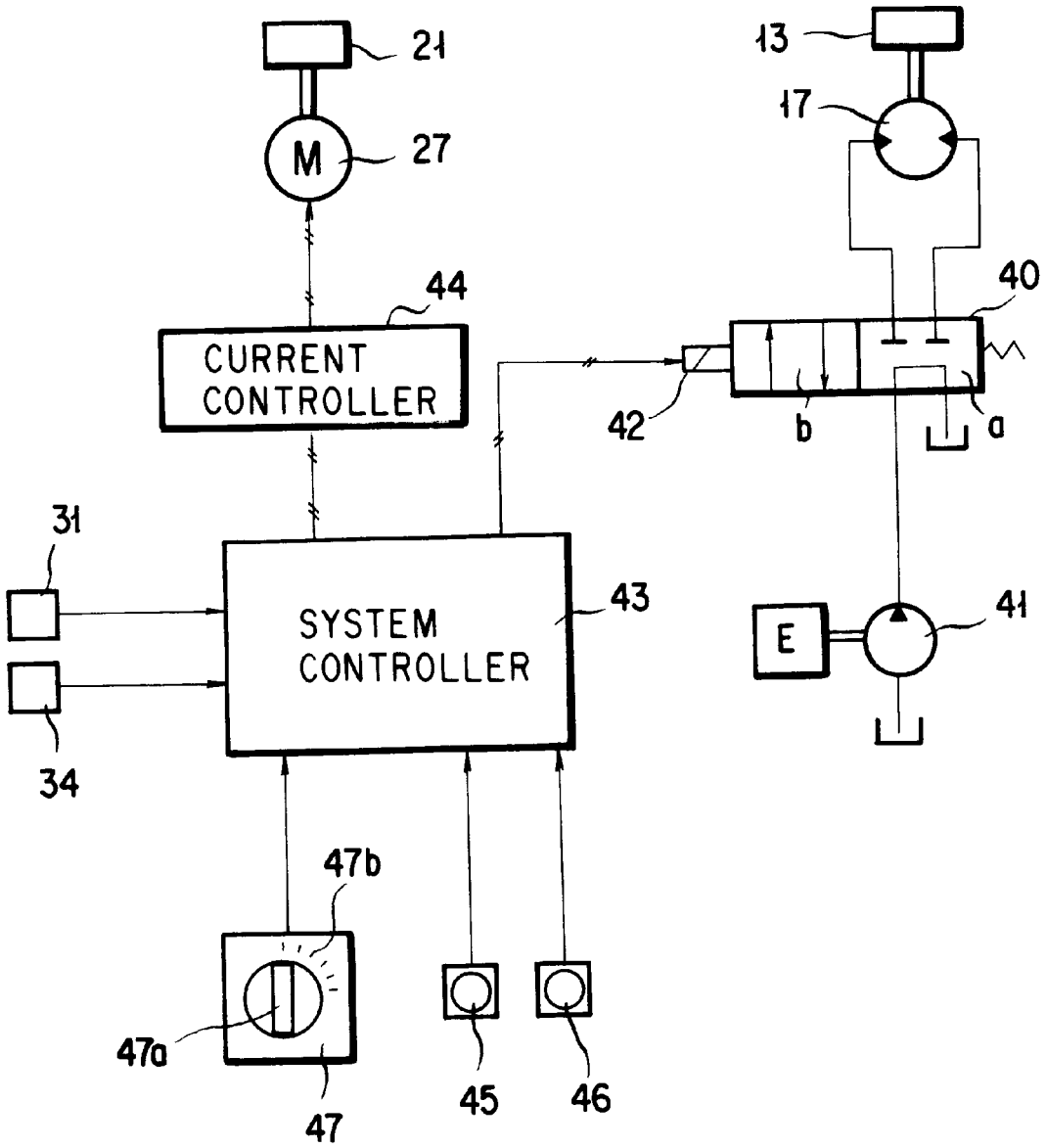
FIG. 4 is a control circuit diagram for the above mentioned embodiment of the present invention.

A control circuit that is here used in the control apparatus according to the present invention is shown in FIG. 4. It may be seen that the hydraulic motor 17 mentioned earlier is furnished with a discharge pressure fluid from a hydraulic pump 41 via an electromagnetic proportional switching valve 40. The switching valve 40 is normally assuming its drain position a and will be switched to assume a supply position b with a solenoid 42 is energized when an electric signal. A system controller 43 is provided to control the magnitude of the electric current applied to the solenoid 42, to thus control the area of aperture of the electromagnetic proportional switching valve 40 and in turn to control the speed of rotation of the hydraulic motor 17, that is proportional thereto.

The electric motor 27 mentioned earlier is designed so that its speed of rotation is controlled by the magnitude of the electric current applied thereto by means of an electric current controller 44 that may be constituted, say, by an inverter, which is in turn designed to receive a speed command from the controller 43.

The system controller 43 is designed so as to be furnished with feedback signals which are provided from the earth and sand material switch 31 and the earth and sand material feeder blade position sensing switch 34 as well as operation signals from a service switch 45 and a stop switch 46 and further with a command signal representing the supply rate of the soil refining material, which is provided from a soil refining material supply rate setting means 47.

While the embodiment described above is designed to maintain the supply rate of the earth and sand material substantially constant by using the soil refining material supply rate setting means 47, it should be noted that it is alternatively possible to render the supply rate of the earth and sand material variable while using an earth and sand material supply rate setting means.

It should also be noted that the soil refining material supply rate setting means 47 in the above mentioned embodiment is constituted by a potentiometer device having a dial 47*a* and a graduation 47*b* so that rotating the dial 47*a* in registration with the graduation 47*a* may cause a command voltage value to be furnished as an output signal.

An explanation will now be given with respect to an operation of the above described control apparatus embodied according to the present invention.

First, earth and sand material that has been yielded from excavating a groove in rough ground with the bucket of a power shovel or the like will be loaded in the earth and sand material hopper 18 whereafter the dial 47*a* of the soil refining material supply rate setting means 47 may be rotated to establish a particular value for the supply rate of the soil refining material in accordance with the nature of the earth and sand material loaded. This will cause the established value for the soil refining material supply rate to enter into the system controller 43 as a control command.

Then, when an actuation signal from the service switch 45 is furnished into the controller 43, it follows that the controller 43 will act to electrically energize the solenoid 42 of the electromagnetic proportional switching valve 40 to cause the latter to assume the supply position b so that the hydraulic motor 17 may be supplied with the pressure discharge fluid of the hydraulic pump 41 to rotate the earth and sand material feeder 13 in the direction of the arrow shown in FIG. 2. Then, the system controller 43 will be operated to compute the speed of rotation of the hydraulic motor 17 from the magnitude of the electric current passed through the solenoid 42 and in turn to compute the speed of rotation of the earth and sand material feeder 13. It should be noted at this point that the speed of rotation of the earth and sand material feeder 13 may also be detected mechanically by a mechanical sensor.

And, the raking blade 29 will act to rake the earth and sand material contained in each individual one of the successive feeder chambers 30 so as to maintain an amount of the material therein substantially constant. Further, a continued rotation of the earth and sand material feeder 13 will cause the earth and sand material switch 31 to turn ON, thereby furnishing the system controller 43 with an ON signal thus produced.

In receipt of each ON signal from the earth and sand material switch 31, the system controller 43 will determine that each of the successive feeder chambers 30 contains a preset amount of the earth and sand material therein and will then compute a speed command based upon the supply rate of the soil refining material corresponding to the above mentioned nature of the earth and sand material as well as on the established supply rate of the earth and sand material.

A further rotation of the earth and sand material feeder 13 to cause a particular feeder chamber 30 containing the preset amount of the earth and sand material to approach the soil refining material discharge outlet opening 24 of the soil refining material feeder 21, will cause the earth and sand material feeder blade position sensing switch 34 to be turned ON to furnish the controller 43 with an ON signal so produced, thus permitting the system controller 43 to compute, based upon the speed of rotation of the earth and sand material feeder 13 and the distance between the earth and sand material feeder blade position sensing switch 34 and the soil refining material discharge outlet opening 24, the time period it will take the particular feeder chamber 30 in which the amount of the earth and sand material is detected to arrive at the soil refining material discharge outlet opening 24. Stated in other words, the controller 34 will compute the seconds after which an amount of the soil refining material that is commensurate with the detected amount of the earth and sand material may be furnished.

The system controller 43, upon the lapse of the above mentioned time period after the earth and sand feed blade position sensing switch 34 has been turned ON, will furnish the current controller 44 with the speed command, thus permitting the electric motor 27 to rotate at a speed of rotation determined by the speed command and the soil refining material to fall by gravity from the soil refining material discharge outlet opening 24 at a rate determined by the speed of rotation. Also, at the same time the controller 43 will control the magnitude of the current passed through the solenoid 42 to increase and decrease the area of aperture of the electromagnetic proportional switching valve 40, thus permitting the earth and sand material feeder 13 and the soil refining material feeder 21 at their speeds of rotation which are proportioned at a substantially constant ratio. This will allow the soil refining material to be supplied upon the earth and sand material contained one of the feeder chambers 30 and thereafter a further rotation of the earth and sand material feeder 13 will allow the earth and sand material and the soil refining material to cast at a predetermined ratio into the crushing and mixing unit A and to be stirred and mixed together therein to yield an earth and sand material of improved quality.

It should be noted at this point that where the amount of the earth and sand material in the earth and sand material hopper 18 varies or where the earth and sand material is intermittently loaded into the earth and sand material hopper 18 so that the amount of the earth and sand material contained in each of the successive feeder chambers 30 may remain small and after passage under the raking blade 29 may not reach the preset amount, the earth and sand material switch 31 ought to be held OFF, rather than being turned ON.

Then, with the earth and sand material switch 31 being held OFF, the system controller 43 will determine that the preset value of the supply rate of the earth and sand material has not been reached, thus lowering the speed of rotation of the electric motor 27 by permitting the speed command to be transmitted with a delay.

This will cause the supply rate of the soil refining material to be reduced so as to maintain the ratio in volume of the earth and sand material to the soil refining material substantially at a predetermined value, thus maintaining an attainable value of CBR of the soil quality refined earth and sand material substantially at a given value.

While the description set out in the foregoing is directed to a case where the supply rate of the earth and sand material is detected not to exceed a preset value, it should be noted that in a case where the supply rate of the earth and sand material can be detected in a continuous range from the preset value to zero, the speed of rotation of the soil refining material feeder 21 can be computed in accordance with the supply rate of the earth and sand material, thereby controlling the magnitude of the electric current applied to the electric motor 27 so as to control the supply rate of the soil refining material from the preset value to zero continuously while likewise controlling the speed of rotation of the earth and sand material feeder 13.

Also, in a case where the nature of the earth and sand material loaded in the earth and sand material hopper 18 varies, it may be noted that the dial 47*a* can be rotated to reset the supply rate of the soil refining material.

As set forth in the foregoing description, according to the present invention in which where the nature of the earth and sand material is found to vary the supply rate of the soil refining material can be established by the setting means and where the supply rate of the earth and sand material varies the supply rate of the soil refining material can then also likewise be regulated, it can be seen and should be understood that by casting into the crushing and mixing means the soil refining material at a supply rate in accordance with the nature of the earth and sand material and its supply rate, the CBR of the soil quality refined earth and sand material can always be a value that is appropriate.

Also, according to the present invention, it can be seen and should be understood that by permitting a soil refining material to be supplied upon an earth and sand material in each of the successive feeder chambers 30 of the earth and sand material feeder 13, the earth and sand material can be cast simultaneously with the soil refining material into the crushing and mixing means A, thereby improving its soil quality.

Also, since the present invention enables the speed of rotation of the soil refining material feeder 21 to be established in accordance with the nature of the earth and sand material and to be regulated in accordance with the supply rate of the earth and sand material it can be seen and should be understood that simply by casting into the crushing and mixing means A the soil refining material at its supply rate that is commensurate with both the nature and supply rate of the earth and sand material, an appropriate CBR value of the soil refined earth and sand material can then result.

Also, according to the present invention, it can be seen and understood that by virtue of the fact that the amount of the earth and sand material in each of the individual feeder chambers 30 can be made substantially constant and the soil refining material feeder 21 can be rotated at a predetermined speed of rotation when the feeder chamber 30 has arrived at the soil refining material discharge outlet opening 24 of the soil refining material hopper 20, the supply rate of the soil refining material can be made a correct value that is commensurate with the amount of the earth and sand material in the feeder chamber 30, thereby permitting an appropriate value of CBR of the soil quality refined earth and sand material to ensue.

Further, according to the present invention, it can be seen and should be understood that the soil refining material can be uniformly supplied upon the earth and sand material in the feeder chambers since the earth and sand material feeder and the soil refining material feeder are allowed to rotate at their respective speeds of rotation which are proportioned at a substantially constant ratio, thereby permitting an even more appropriate value of CBR of the soil quality refined earth and sand material to ensue.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. For example, in place of the electric motor 27 a hydraulic motor can be used, and in place of the hydraulic motor 17 an electric motor can be used. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A control apparatus for a soil refining machine having a crushing and mixing means, an earth and sand material delivery means for supplying an earth and sand material into the crushing and mixing means, and a soil refining material delivery means for supplying a soil refining material into the crushing and mixing means, the control apparatus comprising:

a sensing means for detecting a supply rate of the earth and sand material being supplied by said earth and sand material delivery means;

a first setting means for optionally establishing a supply rate of the soil refining material to be supplied by said soil refining material delivery means; and a control means responsive to both the rate established by said first setting means and the rate detected by said sensing means for controlling an actual supply rate of said soil refining material being supplied by said soil refining material delivery means, said crushing and mixing means being provided with an inlet opening, said earth and sand delivery means comprising an earth and sand material hopper with a bottom area thereof having an earth and sand material discharge outlet opening located above said inlet opening, and an earth and sand material feeder rotatably mounted in said earth and sand material hopper and adapted to be driven by a first drive source, said soil refining material delivery means comprising a soil refining material hopper with a bottom area thereof having a soil refining material discharge outlet opening located at a position offset from a position at which said earth and sand material discharge outlet opening is located in a direction opposite to a direction in which said earth and sand material feeder is to be rotated, and a soil refining material feeder rotatably mounted in said soil refining material hopper and adapted to be driven by a second drive source, said sensing means being located at a position offset from a position in which said soil refining material discharge outlet opening is located in a direction opposite to the direction in which said earth and sand material feeder is to be rotated, said first setting means being adapted to preset the speed of rotation of said second drive source optionally; and said control means being adapted to control the speed of rotation of said second drive source in response to both the rate established by said first setting means and the rate detected by said sensing means.

2. A control apparatus for a soil refining machine, as set forth in claim 1, wherein:

said earth and sand material delivery means includes a plurality of feeder chambers constituting said earth and sand material feeder, and a raking blade located at a position offset from the position at which said soil refining material discharge opening is located in a direction opposite to the direction in which said earth and sand material feeder is to be rotated for maintaining an amount of the earth and sand material received in one of said feeder chambers substantially constant;

said sending means is disposed intermediate between said raking blade and said soil refining material discharge outlet opening; and said control means is assigned a function to compute from the rate detected by both said sensing means and a speed of rotation of said first drive source a time period it will take one of said feeder chambers to arrive at said soil refining material discharge outlet opening as well as a function to bring the speed of rotation of said second drive source into coincidence with a controlled value after said time period has elapsed.

3. A control apparatus for a soil refining machine, as set forth in claim 2, wherein:

said control means is adapted to control the speed of rotation of said second drive source and the speed of rotation of said first drive source simultaneously, thereby permitting said earth and sand material feeder and said soil refining material feeder to rotate at their respective speeds of rotation which are proportioned at a substantially constant ratio.

4. A control apparatus for a soil refining machine, as set forth in claim 1, further comprising a second setting means for optionally establishing a supply rate of the earth and sand material to be supplied by said earth and sand material delivery means.

* * * * *